United States Patent [19]

Adlerteg

[11] 4,357,509

[45] Nov. 2, 1982

[54] ELECTRIC SWITCH

[75] Inventor: Bo Adlerteg, Västerås, Sweden

[73] Assignee: ASEA Aktiebolag, Västerås, Sweden

[21] Appl. No.: 187,340

[22] Filed: Sep. 15, 1980

[51] Int. Cl.[3] ..... H01H 1/20

[52] U.S. Cl. ..... 200/240; 200/153 M; 200/163

[58] Field of Search ..... 200/163, 164 R, 153 M, 200/240, 255

[56] References Cited

U.S. PATENT DOCUMENTS

| | | | |
|---|---|---|---|
| 1,854,039 | 3/1932 | Jones | 200/240 X |
| 3,867,602 | 2/1975 | Jawelak | 200/163 |
| 4,087,668 | 5/1978 | Nakanishi et al. | 200/255 X |
| 4,267,418 | 5/1981 | Brown | 200/163 |

FOREIGN PATENT DOCUMENTS

| | | | |
|---|---|---|---|
| 61351 | 9/1923 | Sweden | 200/163 |

OTHER PUBLICATIONS

IBM Technical Disclosure Bulletin, vol. 8, No. 8, Jan. 1966, p. 1058, by E. C. Uberbacher & P. Edmons.

*Primary Examiner*—William Price

*Assistant Examiner*—Gary E. Elkins

*Attorney, Agent, or Firm*—Watson, Cole, Grindle & Watson

[57] ABSTRACT

An electric switch, for example a load switch or safety switch for low voltage, has at least one fixed contact member and two movable contact members, which form parallel current paths and which, in the closed position of the electric switch, are pressed against the fixed contact member on opposite sides thereof under the influence of contact pressure springs. Closing and opening are accomplished by means of a wedge-formed element which is displaceable between the movable contact members, said element being arranged on an operating member linearly displaceable between two end positions. The movable contact members are guided in the switch body in such a way that they move perpendicular to the direction of displacement of the operating member. The movable contact members are of elongated cross-section and have defined contact surfaces and break points. Upon closing and opening of the switch, the movable contact members are forced to rotate with respect to the fixed contact member, which results in a reduced risk of contact welding.

4 Claims, 10 Drawing Figures

ELECTRIC SWITCH

TECHNICAL FIELD

This invention relates to an electric switch of the kind comprising a switch body, at least one fixed contact member mounted on the switch body, two elongated, substantially parallel, movable contact members which, in the closed position of the switch, are pressed under the influence of contact pressure springs, against said at least one fixed contact member on opposite sides thereof, a wedge-shaped element displaceable between the movable contact members for opening and closing the switch, said element being arranged on an operating member which is linearly displaceable between two end positions, and means guiding the movable contact members in the switch body in such a way that, during the displacement of the operating member, they move substantially perpendicular to the direction of displacement of the operating member. The switch according to the invention is intended to be used in particular, but not exclusively as a load switch for low voltage, by which is meant voltages of up to 1000 V.

A load switch is intended to make, carry and break current both during normal operation and during certain operational overload conditions. In addition, it should be able, in the closed position, to withstand a short-circuit current without being damaged up to the moment when the current is broken, for example by a fuse arranged in series with a switch. Load switches are not designed for breaking short-circuit currents, but on the other hand they should be capable of making a short-circuit current without being damaged, for example by contact welding.

BACKGROUND ART

Electric switches are known which comprise movable contacts consisting of two parallel contact arms which, in the closed position of the switch, are pressed by means of springs each against one side of two fixed knife-shaped contact bars arranged in spaced relationship to each other (see German Patent Specification No. 1,197,160). Since the two contact arms are traversed by current in the same direction, an electrodynamic contact pressure amplification is obtained, which eliminates the risk of contact lifting when the contacts are traversed by a short-circuit current. Such a switch having two parallel, movable contact arms gives a relatively cheap, simple and space-saving construction. However, it displays certain drawbacks, in particular upon making a short-circuit current. For such an operation, the known switch design is heavy to operate because of the electrodynamic attractive forces between the parallel current-traversed contact arms, which results in high friction between the contact surfaces.

In German Offenlegungsschrift No. 1,951,330 there is disclosed an auxiliary contact device with two parallel contact members, movable in opposite directions, which, in the closed position of the device, are pressed by means of springs each against one side of two fixed contact members arranged in spaced relationship to each other. Opening is effected by means of a wedge-shaped element, displaceable between the movable contact members, the contact members then moving perpendicular to the direction of displacement of the wedge-shaped element. This device employs movable contact members of circular cross-section which results, among other things, in the drawback that no defined closing and opening points are obtained, so that welding and burn damage may arise at any point on the contact surfaces.

The present invention aims to provide an improved electric switch of the kind referred to, in which the abovementioned drawbacks are avoided.

DISCLOSURE OF INVENTION

According to the invention, in an electric switch of the kind referred to, said movable contact members are of elongated cross-section and are guided between said wedge-shaped element and said contact pressure springs in such a way that they are rotated with respect to said at least one fixed contact member during both contact closing and contact opening, thus achieving a rolling contact movement.

During operation of an electric switch in accordance with the invention, the movable contact members will close and open at the contact tip, and further they are constructed so as to roll on the fixed contact members. The risk of contact welding is therefore small. If, in spite of this, a contact weld should occur, the weld may be broken relatively easily because the wedge-shaped element, insertable between the movable contact elements, subjects the movable contact members to a torsional moment. Because the movable contact members are separated by force, the additional advantage is obtained that the actuating member (e.g. a handle or the like) of the electric switch cannot indicate "off" if the contacts have welded, which is of considerable importance from the point of view of safety.

BRIEF DESCRIPTION OF DRAWINGS

The invention will now be described, by way of example, with reference to the accompanying drawings, in which.

DESCRIPTION OF PREFERRED EMBODIMENTS

Figure 1:
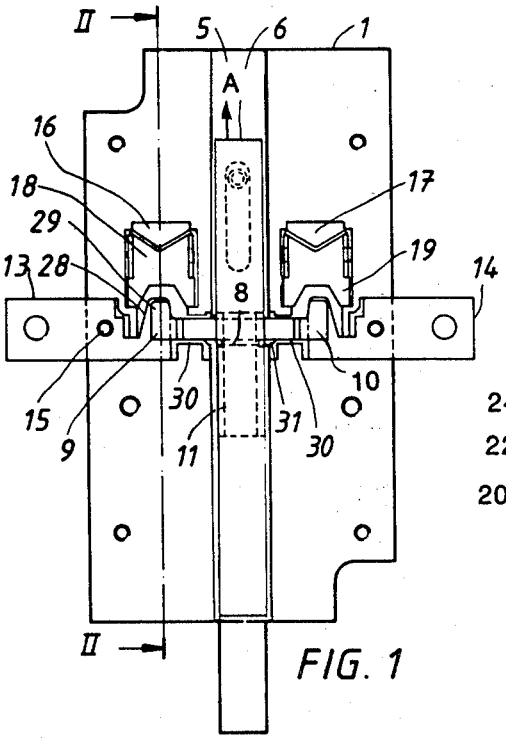
FIG. 1 is a view from below of a load switch in accordance with the invention, shown in the closed position, the bottom portion of the switch being shown partially removed.

The load switch shown in FIGS. 1 to 7 has a body of electrically insulating material, consisting of an upper portion 1 (viewed from below in FIG. 1 and from above in FIG. 3) and a lower portion or cover 2, which are secured together by means of screws 3. The lower portion 2 is provided with holes 4 (FIG. 3) for fixing the switch to a base (not shown).

Figure 5:
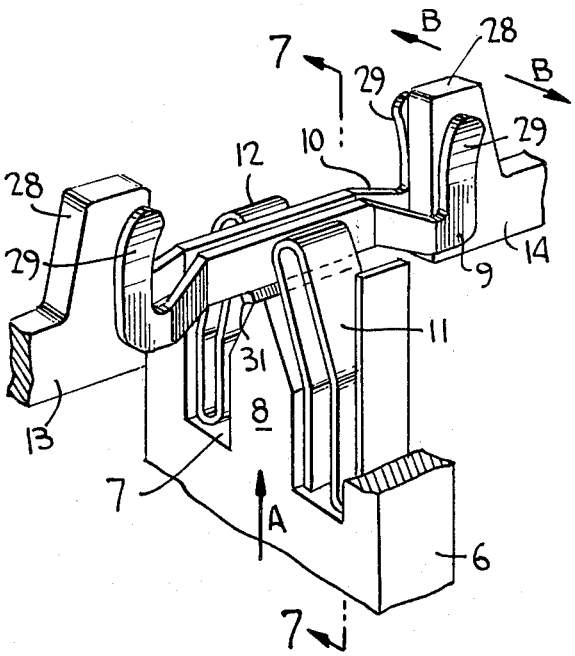
FIG. 5 is a perspective view showing a closed switch condition between movable contact members and fixed contact members, upon operation of an operating member, the top and bottom portions of the switch being omitted for clarity.
Figure 6:
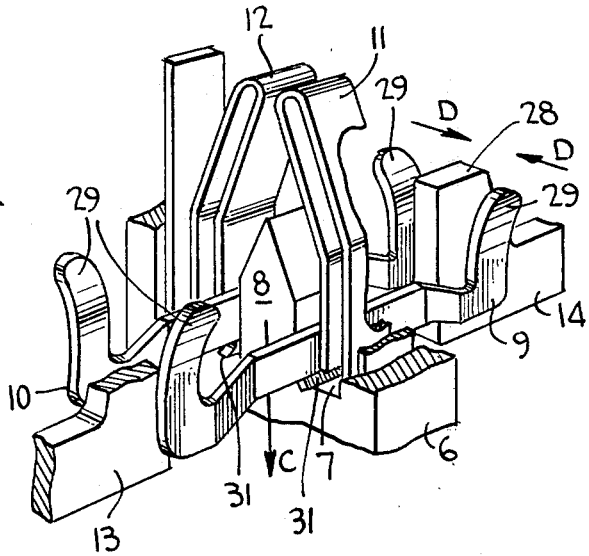
FIG. 6 is a view similar to FIG. 5 showing an open switch condition between the movable and fixed contact members upon operation of the operating member.
Figure 7:
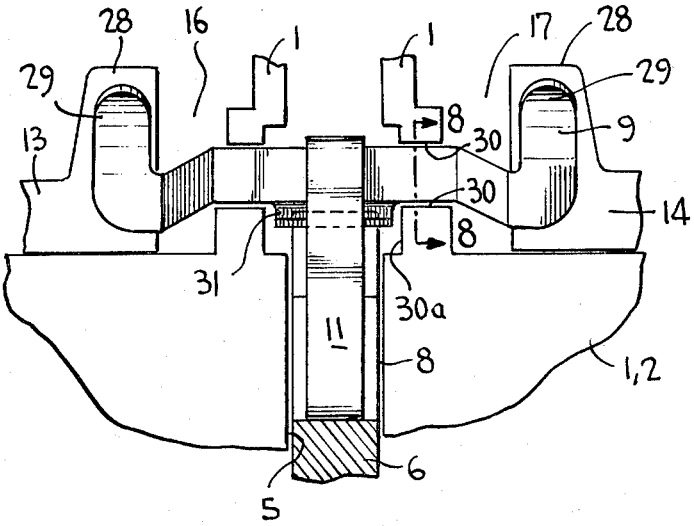
FIG. 7 is a view taken substantially along the line 7—7 of FIG. 5 showing one of the movable contact members relative to the top portion of the switch.

The assembled body portions 1 and 2 form between themselves an elongated groove 5 of substantially rectangular cross-section, in which an operating member 6 in the form of a rectangular plate is displaceable in the direction of arrow A (FIGS. 2 and 5) and in an opposite direction of arrow C (FIG. 6). The operating member 6 has a multi-sided through-opening 7, one side of which is formed by a wedge-shaped element 8 extending in the direction (arrow A) of displacement of the operating member 6. Through the opening 7 there extend, as more clearly shown in FIGS. 5 and 6, two parallel movable contact members 9, 10, which are resiliently urged in a direction towards each other by plate springs 11, 12, arranged one on each side of the wedge-shaped element 8 and respectively bearing against the central portions of members 9 and 10 as shown in FIGS. 5 to 7. The movable contact members are "floating" members in that they are unattached to member 6 or to switch body portions 1 and 2.

Figure 2:
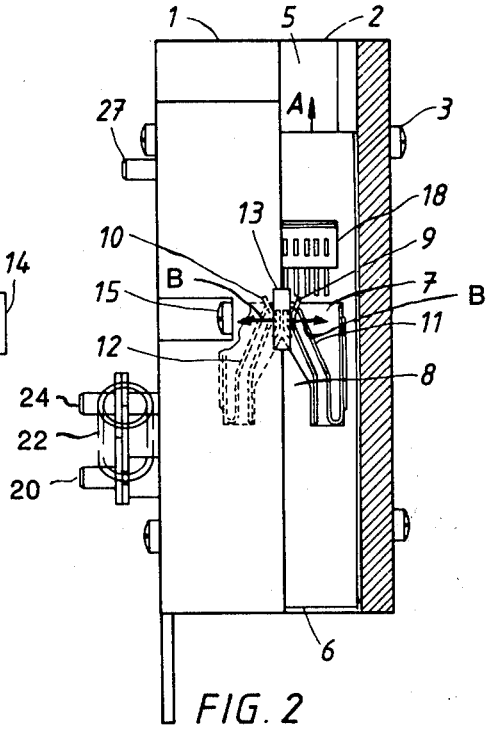
FIG. 2 is a side view of the switch of FIG. 1, taken along the line II—II therein, with its bottom portion being shown partially removed.
Figure 3:
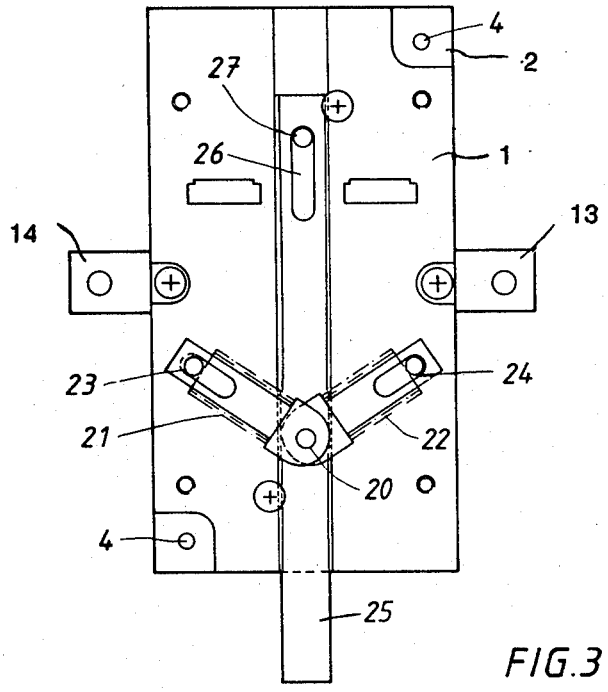
FIG. 3 is a view from above of the switch of FIG. 1.

In the plane of separation between the body portions 1 and 2 two fixed contact members 13, 14, having their inner ends spaced apart on opposite sides of member 6, are fixed to the upper body portion 1 by means of screws 15. The space between the fixed contact members 13, 14 is bridged by the movable contact members 9, 10 which are arranged one on each side of the fixed contact members, as is clear from FIGS. 2, 5 and 6. As shown in FIGS. 1 and 2, member 9 is disposed beneath member 13, and member 10 is disposed above member 14.

The switch has two chambers 16, 17 respectively lying on opposite sides of the groove 5, these chambers housing a stack of extinction plates 18, 19, respectively.

The actuating mechanism of the switch (see FIG. 3) comprises two pressure spring assemblies 21, 22 which are connected together at a toggle joint 20, the assemblies 21, 22 including helical springs and being pivotable about pivot pins 23, 24 fixedly secured in the upper body portion 1. At the joint 20 the assemblies are connected to a displaceable slide 25, which has an elongated recess 26 in which there is engaged a pin 27 which is fixedly secured to the operating member 6. Closing and opening of the switch are accomplished by displacing the joint 20, and thus the slide 25, by a handle, or the like (not shown). During the first part of the operating movement, the springs are tensioned without the operating member 6 moving. When the joint 20 passes through the position in which it lies in the same plane as the shaft pins 23, 24, the spring energy is released, with the result that the slide 25 rapidly moves the operating member 6 to its opposite position (arrow A) by way of the pin 27. The operation is completed independently of the speed at which the handle is operated.

Both the fixed and the movable contact members have tongue-shaped end portions 28, 29 positioned in the switch chambers 16, 17 and directed towards the stacks of extinction plates 18, 19. Upon breaking, the current will therefore have a loop-formed path, and the breaking arcs will be moved into the stacks of extinction plates, under the influence of electrodynamic forces, where they are cooled and extinguished.

Since the two movable contact members 9, 10 are traversed by current in the same direction, an electrodynamic contact pressure amplification is obtained, thus eliminating the risk of contact lifting when the switch is traversed by a short-circuit current. The contact pressure amplification is especially great because the movable contact members 9, 10, in the region between the fixed contact members 13, 14, are pressed down so that the distance between them is very small.

Figure 4:
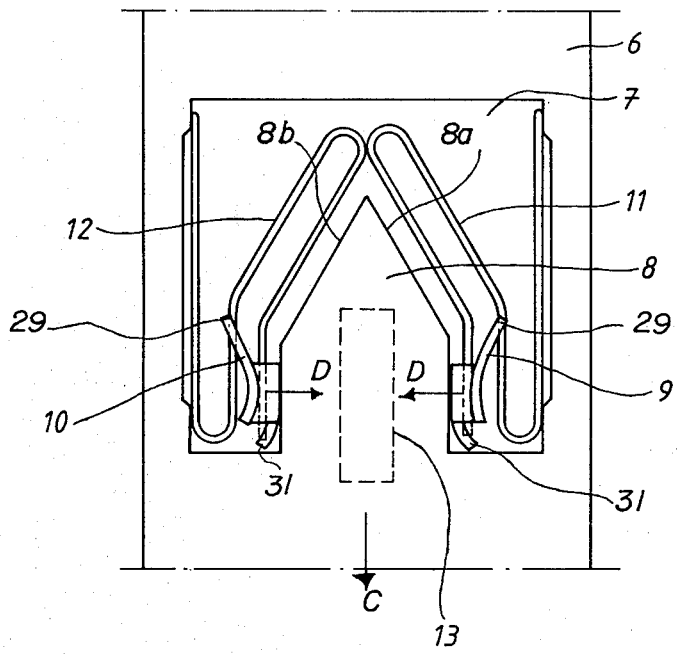
FIG. 4 is a side view, on an enlarged scale, of the central part of the switch of FIG. 1, with the movable contact members shown in the open position.
Figure 8:
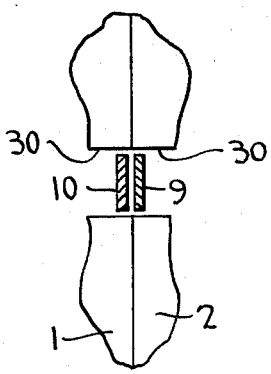
FIG. 8 is a sectional view taken substantially along the line 8—8 of FIG. 7.

The switch is shown in FIGS. 1, 2, 5 and 7 in a closed condition wherein end portions 29 of the movable contact members 9 and 10 are resiliently urged tightly against opposite faces of end portions 28 of the fixed contact members 13 and 14 under the force of springs 11 and 12. In this position, the central portions of members 9 and 10 are in contact as shown in FIGS. 5 and 8. Members 9 and 10 are provided with guide lugs 31 extending toward element 8 and curving away from one another as seen in FIGS. 2 and 5, the pointed nose of element 8 lying between the curved guide lugs. The central portions of members 9 and 10 lie within transversely extending grooves 30 provided in switch body portions 1 and 2, as shown in FIGS. 1, 7 and 8, so as to be thereby immobilized against movement longitudinally of the switch body. And, guide lugs 31 on members 9 and 10 extend into slots 30*a* opening into grooves 30 (FIGS. 1 and 7) to prevent shifting movement of members 9 and 10 longitudinally thereof and transversely of the switch body. Members 9 and 10 are, however, free to move only away from and toward one another respectively in the direction of arrows B and D (FIGS. 2 and 4). During such movement, the movable contact members are guided within grooves 30 and within slots 30*a*.

Therefore, to open the switch from the closed position of FIGS. 2, 5 and 7, operating member 6 is displaced in the direction of arrow A, under the influence of springs 21 and 22, whereupon its wedge-shaped element 8 enters in between the central portions of members 9 and 10 and moves them apart against the resilience of springs 11 and 12. It can be seen that guide lugs 31, which curve away from one another, facilitate entry of element 8 in between the movable contact members to a position shown in FIGS. 4 and 6. As element 8 enters in between members 9 and 10, the sloping edges 8*a* and 8*b* of the wedge-shaped element (FIG. 4) effect a rolling movement of end portions 29 against end portions 28 of the fixed contact members before moving the movable contact members out of contact with the opposing faces of the fixed contact members 13 and 14 in the direction of arrows B. Continued displacement of member 6 effects separation of members 9 and 10 to the fully open position of FIGS. 4 and 6. It can be seen that plate springs 11 and 12 bear continuously against the central portions of members 9 and 10 as they are shifted apart between their FIGS. 5 and 6 positions. And, in the fully open position of the switch, members 9 and 10 rest against the root portion of opening 7, as shown in FIGS. 4 and 6.

To close the switch, operating member 6 is displaced in the opposite direction C of FIGS. 4 and 6 whereupon element 8 is moved from its position in between members 9 and 10 (FIG. 6) to its FIG. 5 position. Contact closing (as well as contact opening) takes places at the contact tips of end portions 29, whereafter the movable contact members will effect a rolling movement on the fixed contact members to the FIGS. 2 and 5 position while moving in the direction of arrows D. If the closing is performed against a short-circuit, material fusion will take place at the contact tips, but, because of the contact rolling, the contact points are moved away from the contact closing points, thus reducing the risk of contact welding. If contact welding should occur in spite of this, the wedge-shaped element 8 will subject the movable contact members to a torsional movement during the next opening operation so that the weld is broken loose, whereafter the contact members are separated by force.

Figure 9:
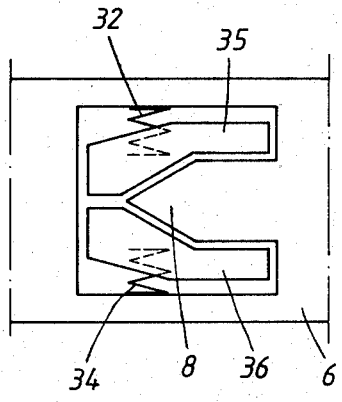
FIG. 9 is a view similar to FIG. 4 of an alternative embodiment of the central part of the switch, the contact members being removed.

The contact pressure springs and the guiding of the movable contact members may be carried out in many different ways. FIG. 9 shows an embodiment using helical springs 32, 34 instead of plate springs 11, 12, which helical springs influence the contact members 9, 10 (not shown in FIGS. 5 and 6) by way of locating pieces 35, 36, preferably of a plastics material giving low friction when sliding against the contact members 9, 10.

Figure 10:
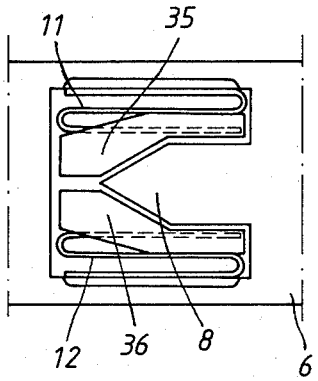
FIG. 10 is a view similar to FIG. 5 of a third embodiment of the central part of the switch.

FIG. 10 shows a further embodiment using locating pieces 35, 36, in which the contact pressure springs consist of plate springs 11, 12.

What is claimed is:

1. In an electric switch comprising a switch body, at least one fixed contact member mounted on the switch body, two elongated, substantially parallel, movable contact members which, in the closed position of the switch, are pressed under the influence of contact pressure springs against said at least one fixed contact member on opposite sides thereof, a wedge-shaped element displaceable between the movable contact members for opening and closing the switch, said element being arranged on an operating member which is linearly displaceable between two end positions, and means guiding the movable contact members in the switch body in such a way that, during the displacement of the operating member, they move substantially perpendicular to the direction of displacement of the operating member, the improvement according to which said movable contact members are of elongated cross-section and are guided between said wedge-shaped element and said contact pressure springs for rotation with respect to said at least one fixed contact member during both contact closing and contact opening, thus achieving a rolling contact movement.

2. An electric switch according to claim 1, comprising two fixed contact members arranged in spaced relationship to each other, said movable contact members forming a contact bridge between said fixed contact members, and said movable contact elements are provided with guiding lugs for guiding said wedge-shaped element in between said movable contact members.

3. An electric switch according to claim 2, in which said movable contact members are constructed so that the distance between the middle portions is smaller than the distance between the contact surfaces of the members, which contact surfaces are positioned on opposite sides of said fixed contact member.

4. An electric switch according to claim 1 or 2, in which locating pieces for said movable contact members are arranged between said contact pressure springs and said wedge-shaped element.

* * * * *